US006015241A

United States Patent [19]

Wiklof et al.

[11] Patent Number: 6,015,241

[45] Date of Patent: Jan. 18, 2000

[54] PRINTER FEEDBACK CONTROL AND EVENT LIBRARY TO COMPENSATE FOR AND PREDICT VARIABLE PAYOUT FORCES

[75] Inventors: Christopher A. Wiklof, Everett; Pixie A. Austin, Marysville, both of Wash.

[73] Assignee: Intermec IP Corp., Woodland Hills, Calif.

[21] Appl. No.: 08/999,384

[22] Filed: Dec. 18, 1997

Related U.S. Application Data

[63] Continuation-in-part of application No. 08/467,210, Jun. 6, 1995.

[51] Int. Cl.[7] ..... B41J 13/00

[52] U.S. Cl. ..... 400/578; 400/582; 400/615.2

[58] Field of Search ..... 400/615.2, 578, 400/582

[56] References Cited

U.S. PATENT DOCUMENTS

| | | | |
|---|---|---|---|
| 3,866,851 | 2/1975 | Brooks . | |
| 3,899,143 | 8/1975 | Slezak . | |
| 3,949,949 | 4/1976 | Thompson . | |
| 3,985,603 | 10/1976 | Berner . | |
| 3,985,605 | 10/1976 | Treiber et al. . | |
| 3,989,929 | 11/1976 | Treiber . | |
| 4,363,692 | 12/1982 | Imamura et al. . | |
| 4,558,963 | 12/1985 | Applegate et al. . | |
| 4,605,938 | 8/1986 | Matsuno et al. | 346/76 |
| 4,657,418 | 4/1987 | Lahr . | |
| 4,721,267 | 1/1988 | Nieto et al. . | |
| 4,755,070 | 7/1988 | Cerutti . | |
| 4,788,558 | 11/1988 | Caldwell et al. | 346/76 |
| 4,812,063 | 3/1989 | Kunimitsu et al. . | |
| 4,860,025 | 8/1989 | Berson et al. . | |
| 4,878,773 | 11/1989 | Mazumder . | |
| 4,919,555 | 4/1990 | Kikuchi . | |
| 4,934,847 | 6/1990 | Shiozaki et al. . | |
| 4,949,098 | 8/1990 | Gluck et al. . | |
| 4,953,994 | 9/1990 | Shiozaki et al. . | |
| 4,973,985 | 11/1990 | Genno et al. . | |
| 4,974,977 | 12/1990 | Morgan et al. . | |
| 4,982,202 | 1/1991 | Buan et al. . | |
| 5,032,032 | 7/1991 | Chu et al. . | |
| 5,040,461 | 8/1991 | Van-Ocker . | |
| 5,122,882 | 6/1992 | Ishida et al. . | |
| 5,162,815 | 11/1992 | Hodge | 346/76 |
| 5,172,989 | 12/1992 | Imaseki et al. . | |
| 5,245,354 | 9/1993 | Ono et al. . | |
| 5,260,716 | 11/1993 | Maslanka . | |
| 5,338,443 | 8/1994 | McEwen . | |
| 5,366,307 | 11/1994 | McGourty et al. | 400/708 |
| 5,372,439 | 12/1994 | Poole et al. . | |
| 5,647,679 | 7/1997 | Green et al. | 400/232 |
| 5,816,719 | 10/1998 | Palmer | 400/120.01 |
| 5,859,656 | 1/1999 | Aragon et al. | 347/218 |

*Primary Examiner*—Ren Yan
*Assistant Examiner*—Charles H. Nolan, Jr.
*Attorney, Agent, or Firm*—O'Melveny & Myers LLP

[57] ABSTRACT

An apparatus for use in a thermal printer for printing information onto a paper substrate material is provided. The apparatus enables the thermal printer to compensate for the variable payout force of the paper substrate material. The apparatus comprises a platen in contact with the paper substrate material at a print region of the thermal printer. A motor and a roller mechanically coupled to the motor are used to transport the paper substrate material through the print region. A rotational rate detector comprises a light source, a disk having alternating radially disposed regions of different light conductivity, and a photodetector adjacent to the disk. The disk is at least partially illuminated by light provided by the light source and the photodetector to provide an electrical signal corresponding to detected periodic changes of the light illuminated onto the disk during rotation of the disk in cooperation with the platen. A central processor is adapted to receive the electrical signal and provide a driving signal to the motor. The driving signal compensates for the variable payout force by altering a corresponding transport rate of the paper substrate material in accordance with the detected rotational rate of the disk, an event model stored in a RAM, and/or a harmonic model stored in the RAM.

25 Claims, 8 Drawing Sheets

FIG. 3
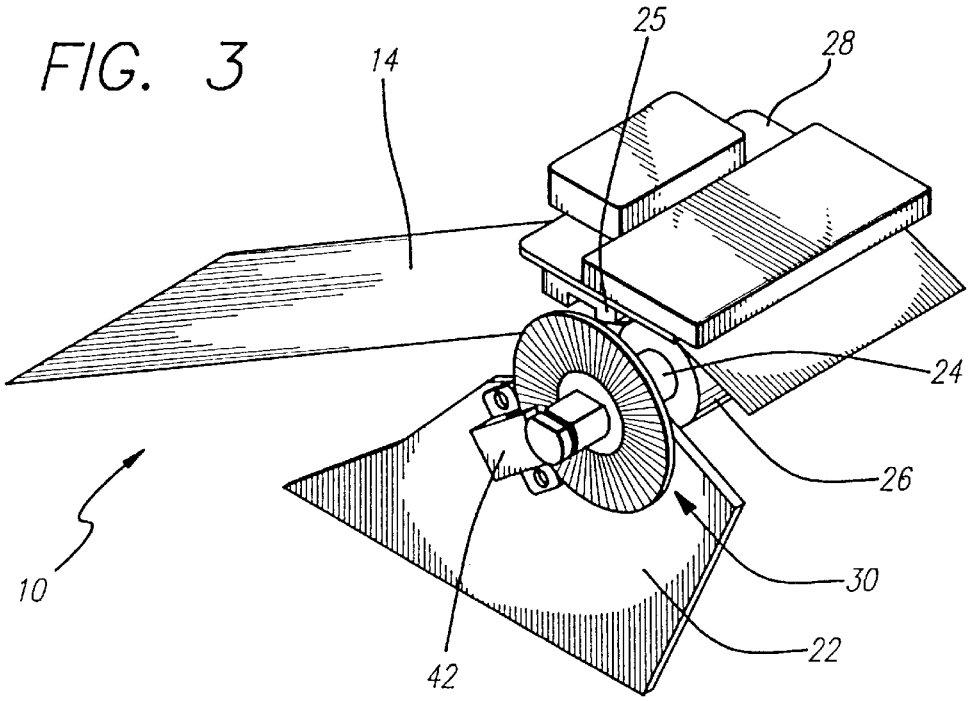
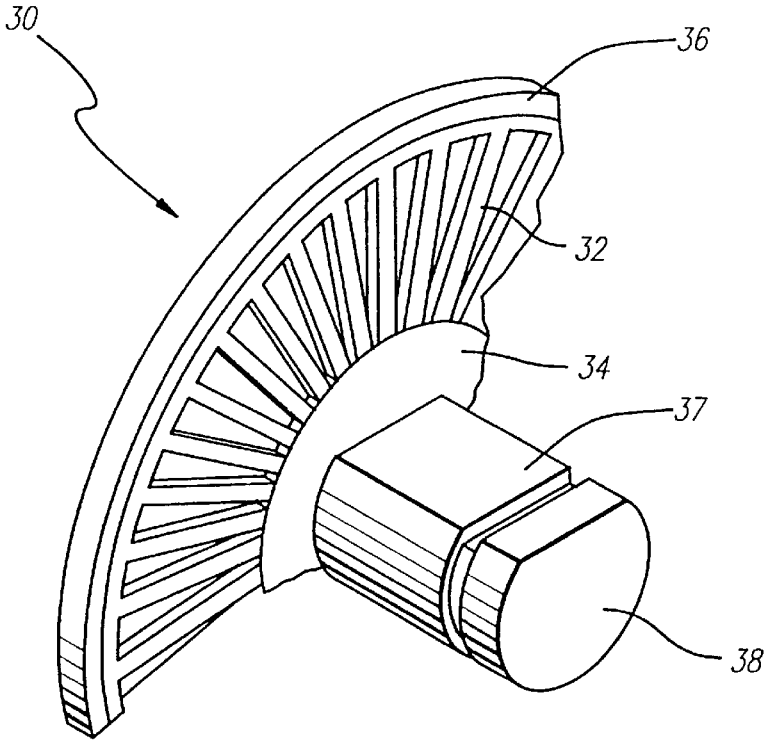
FIG. 4

FIG. 6
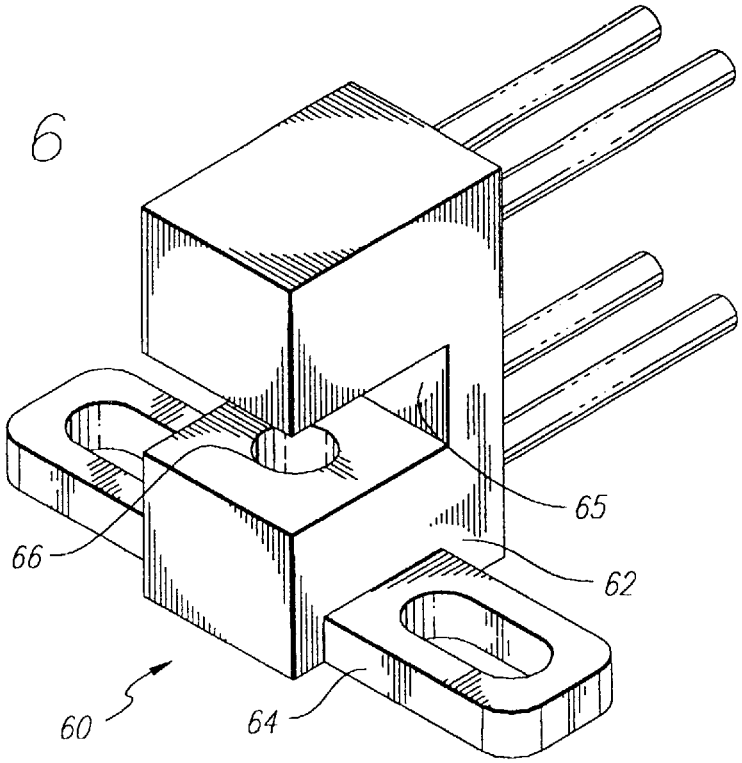
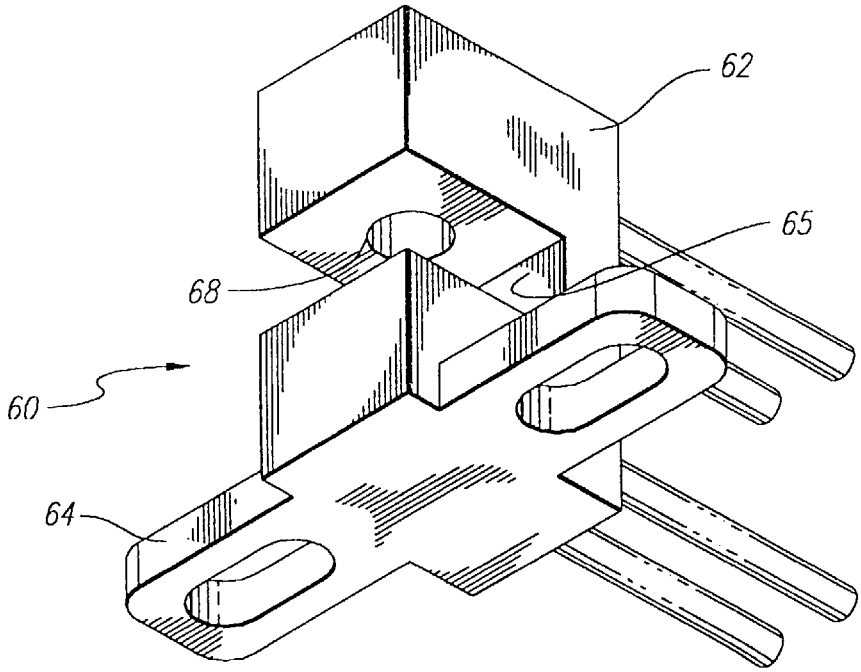
FIG. 7

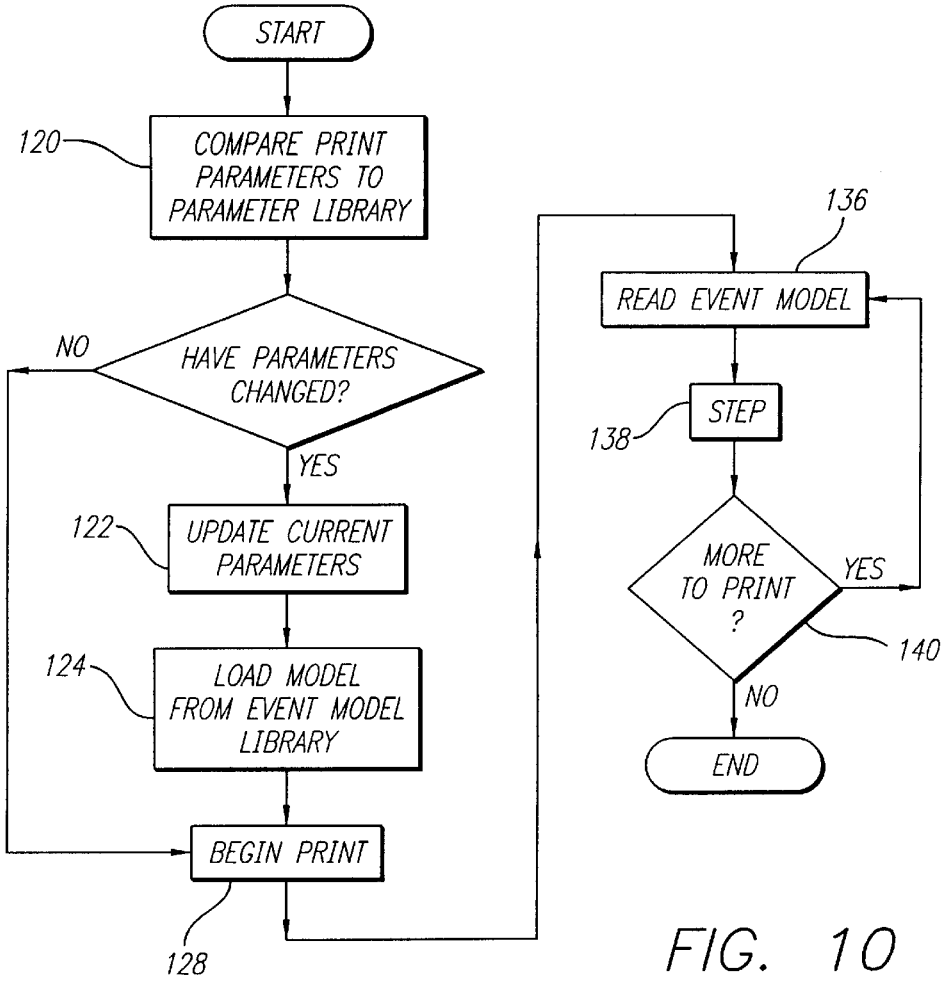
FIG. 10
FIG. 11
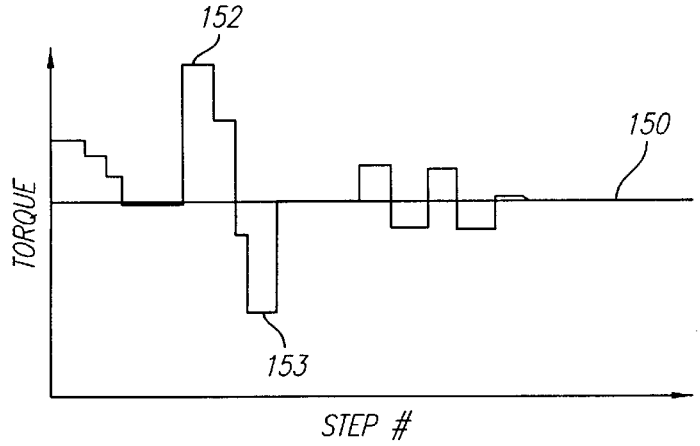

PRINTER FEEDBACK CONTROL AND EVENT LIBRARY TO COMPENSATE FOR AND PREDICT VARIABLE PAYOUT FORCES

RELATED APPLICATION

The present application is a continuation-in-part of copending application Serial No. 08/467,210, filed Jun. 6, 1995, entitled PRINTER FEEDBACK CONTROL TO COMPENSATE FOR VARIABLE PAYOUT FORCE.

BACKGROUND OF THE INVENTION

1. Field of the Invention

The present invention relates to thermal printing, and more particularly, to a printing method and apparatus utilizing feedback control to compensate for variations in the transport rate of the print media.

2. Description of Related Art

In the field of bar code symbology, parallel bars of varying thicknesses and spacing are used to convey information, such as an identification of the object to which the bar code is affixed. To read the bar code, the bars and spaces are scanned by a light source, such as a laser. Since the bars and spaces have differing light reflective characteristics, the information contained in the bar code can be read by interpreting the laser light after it has reflected from the bar code.

Bar codes are often printed onto paper substrate labels that can be affixed to the objects intended to be identified. The paper substrate labels typically comprise a face material onto which the bar code is printed with an adhesive backing layer applied to an opposite surface of the face material that permits the labels to be affixed to an object. The face material may be further laminated onto a release liner having a low-stick surface that allows the label to be removed easily. After the label is printed, the user can simply peel off the face material from the release liner, and apply the label onto an object. In order to accurately read the bar code, it is thus essential that the bar code be printed in a high quality manner, without any streaking or blurring of the bar code. Moreover, it is essential that the adhesive backing layer of the labels not be damaged by heat generated during the printing process, otherwise the labels will not stick properly to the object.

In view of these demanding printing requirements, bar codes are often printed using thermal printing techniques. In thermal printing, the face material of the paper substrate labels is impregnated with a thermally sensitive chemical that is reactive upon exposure to heat for a period of time. Alternatively, an ink ribbon may be utilized that is selectively heated to transfer ink to the face material. The labels are drawn across a thermal print head having linearly disposed printing elements that extend across a width of the labels. The printing elements are selectively activated in accordance with instructions from a controller to heat localized areas of the substrate or ink ribbon, thereby creating a dark image by a chemical reaction brought on by the heat. As the labels are drawn through a print region between a platen and the thermal print head, the bar code is printed onto the face material. Other images, such as text or graphics characters, can also be printed in the same manner.

The thermal printer includes a mechanism for transporting the labels from a supply spool to the print region. The transporting mechanism controls the feed rate of the labels from the spool, and maintains a positive tension on the labels so as to prevent their wrinkling which could cause a defect in the printed bar code. The transporting rate must be controlled so that it synchronizes with the activation rate of the printing elements in order to print the labels accurately. If the transport rate of the labels were to momentarily slow down, stop or speed up while the printing elements were activated, the printing would be disrupted and, in the worst case, the substrate material of the labels could be burned or torn. Thus, the paper substrate labels are transported at a substantially uniform rate in order to obtain substantially defect-free printing.

In a new formulation of the paper substrate labels, the release liner is eliminated, and the labels are simply wound onto themselves with the backing layer adhering directly to the face material of subsequent labels. These so-called "linerless" labels include an adhesive backing layer specifically formulated to prevent formation of a permanent adhesive bond, enabling the labels to be subsequently peeled off without damaging the face material. Linerless labels are more convenient than conventional labels for certain types of applications, and elimination of the release liner reduces a substantial amount of waste material normally generated in the labeling process and increases the supply available for printing.

Nevertheless, the adhesive backing layer exerts a force opposite in direction from the transport force applied by the transporting mechanism, referred to as the "payout" force. This payout force must be counteracted by the transport mechanism in order to draw the labels from the spool to the print region. For example, the magnitude of the payout force typically decreases with the decreasing diameter of the label spool as the label supply is exhausted during the printing process. In practice, the variable payout force is often difficult to predict, and cannot be adequately compensated for by the transport mechanism. As a result, a uniform transport rate cannot be achieved and the label print quality becomes degraded.

In a similar manner, the conventional paper substrate labels using release liners (i.e., "linered" labels) are also susceptible to variable payout force. The release liner can occasionally slip off a region of the label causing the label to stick to the label disposed one layer below the current label within the spool or adhesive bleed can cause the liners to stick together. The uneven adhesion force causes variations in the payout of the paper substrate labels.

The problems associated with variations in payout force become more pronounced as print speeds become higher, label spools become longer and more specialized print media is used. In addition, many modern applications are requiring higher print qualities that are sensitive to even smaller variations in payout force. Further, modern printers are allowing for more sophisticated label movements, such as retract, and are including accessories such as cutters, self-strip mechanisms, and batch take-ups. These new movements and accessories, as well as the wear on individual pieces of the transport mechanism, can cause additional variations on the transport rate of the labels through the transporting mechanism.

Accordingly, it would be desirable to provide a transporting mechanism for a thermal printer that is capable of taking advantage of either linered labels or the new formulation of linerless paper substrate labels by compensating for the variable payout force applied by the labels. It would also be desirable to provide a method for compensating for variations in the transport rate of the print media that are caused by variables such as the print media type, individual parts of the transporting mechanism and print modes. Additionally, it would be desirable if this method for compensating for transport rate variations could detect and compensate for unforeseen variables that cause variations in payout force. Ideally, the transporting mechanism would be capable of providing a uniform payout rate of the reformulated labels and be compatible with conventional linered labels so as to synchronize with the activation rate of the printing elements during print operations.

SUMMARY OF THE INVENTION

In accordance with the teachings of the present invention, a method and apparatus for use in a thermal printer for printing information onto a paper substrate material is provided. The method and apparatus enable the thermal printer to compensate for the variable payout force of either linered or linerless paper substrate material.

As in conventional thermal printers, a transport mechanism comprises a platen that comes into contact with the paper substrate material at a print region of the thermal printer. A motor and a roller are used to transport the paper substrate material through the print region. In the present invention, a rotational rate detector is coupled to the platen and comprises a light source, a control disk having alternating radially disposed regions of different light conductivity, and a photodetector adjacent to the disk. The control disk is at least partially illuminated by light provided by the light source and the photodetector to provide an electrical signal corresponding to detected periodic changes of the light illuminated onto the disk during rotation of the control disk in cooperation with the platen. A central processor is adapted to receive the electrical signal and provide a driving signal to the motor. The driving signal compensates for the variable payout force by altering a corresponding transport rate of the paper substrate material in accordance with the detected rotational rate of the control disk, and an event model that predicts upcoming payout forces.

A program memory is also provided and contains program instructions which control the central processor. The program memory contains instructions for converting the electrical signal into an actual step distance and modifying the driving signal if the actual step distance is outside a predetermined range of values. In an alternate embodiment, the program memory provides instructions for generating a harmonic model which is used to compensate for periodic variations in the step distance. The harmonic model can replace the event model, or can be used in conjunction with the event model.

A more complete understanding of the printer feedback control to compensate for variable payout force will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 3 is an enlarged perspective view of a print region of the thermal printer transport mechanism and the printer feedback control apparatus;

FIG. 4 is an enlarged perspective view of a control disk of the printer feedback control apparatus;

FIG. 6 is an enlarged perspective view of a photodetector for use in the printer feedback control apparatus;

FIG. 7 is another enlarged perspective view of the photodetector of FIG. 6;

FIG. 10 is a flow chart illustrating the operation of the printer feedback control utilizing an event library;

FIG. 11 is a chart illustrating the torque/step relationship;

DETAILED DESCRIPTION OF THE PREFERRED EMBODIMENT

Figure 1:
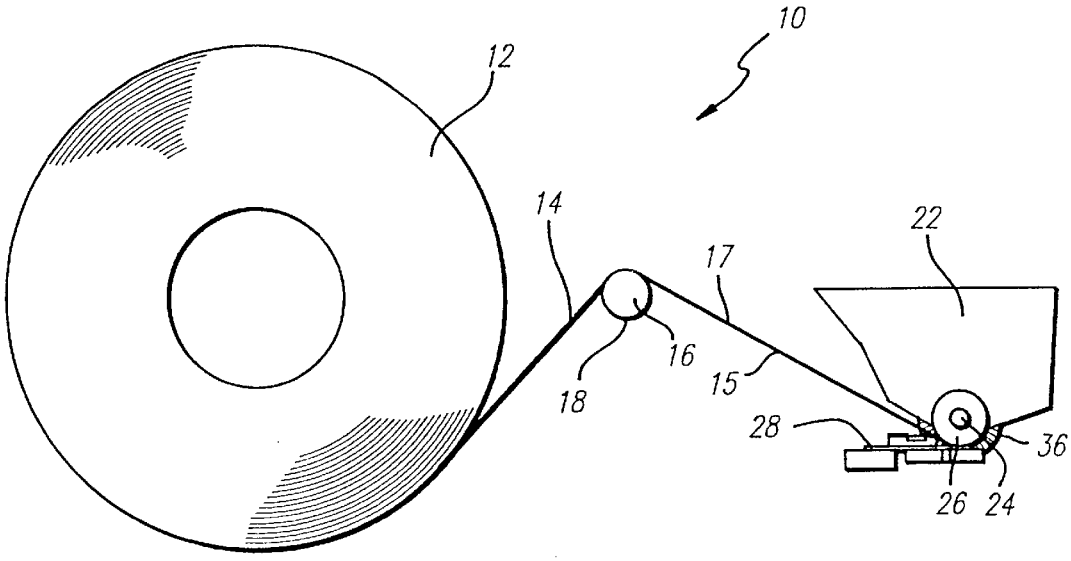
FIG. 1 is a side view of a thermal printer transport mechanism including a printer feedback control apparatus of the present invention.

The present invention satisfies the need for a transporting mechanism for a thermal printer that is capable of taking advantage of either linered paper substrate labels or the new formulation of linerless paper substrate labels by compensating for the variable payout force applied by the labels. The transporting mechanism allows the payout rate of the labels to synchronize with the activation rate of the printing elements during print operations. In addition, the present invention provides a method for compensating for variations in the transport rate of the print media that are caused by the print media type, individual parts of transporting mechanism, printing modes and even unforeseen factors that can affect the transport rate. In the detailed description that follows, it should be apparent that like reference numerals are used to describe like elements of one or more of the figures.

Figure 2:
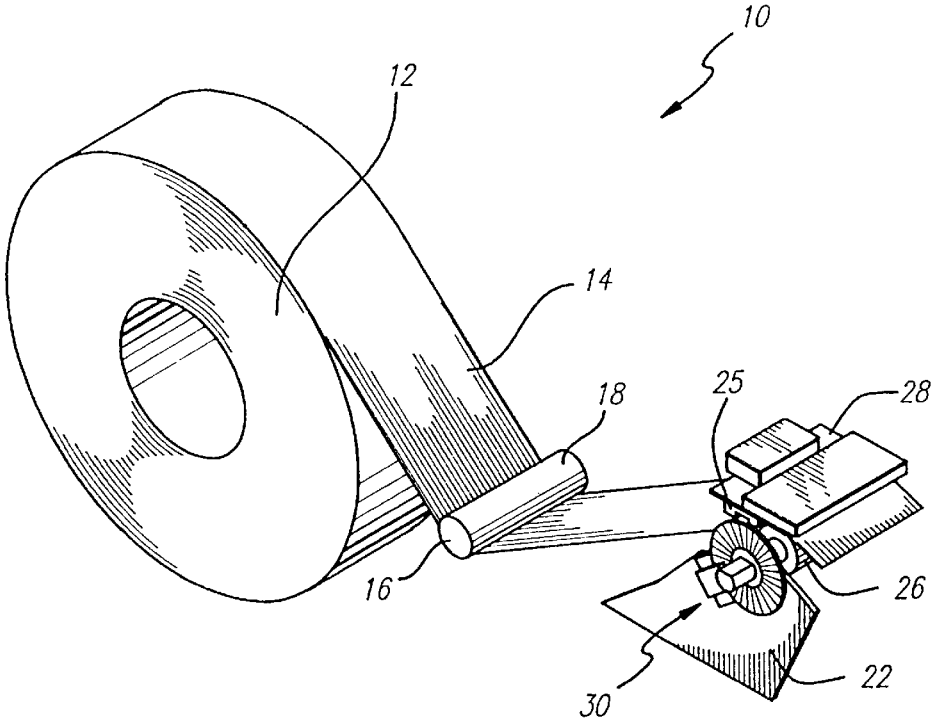
FIG. 2 is a perspective view of the thermal printer transport mechanism and t printer feedback control apparatus.

Referring first to FIGS. 1–3, a transporting mechanism 10 for a thermal printer of the present invention is illustrated. It is anticipated that the transporting mechanism 10 be operable within the environment of a thermal printer (not shown) that provides control signals to the transporting mechanism. The transporting mechanism 10 supplies a linerless paper substrate material 14 from a spool 12 in the form of labels or substrate onto which images, symbols or text would be printed. The linerless paper substrate material 14 has a first surface 15 that comprises face material having a thermally sensitive chemical impregnated therein, and a second surface 17 having an adhesive layer applied thereto. Alternatively, the paper substrate material 14 may be linered, having a release layer that is peeled off to expose the adhesive layer applied to the back of the first surface 15, such that the opposite side of the release layer provides the second surface 17.

The transporting mechanism 10 includes a roller 16 disposed perpendicularly with the transport path of the paper substrate material 14. The roller 16 comprises a slightly abrasive surface 18 that prevents slippage of the paper substrate material 14 as it traverses the roller surface. The roller 16 may be mechanically coupled to a capstan roller that transports the paper substrate material 14 at a constant speed, or may be freely rotatable.

The paper substrate material 14 is transported to a print region that is defined between a thermal print head 25 and a platen 26, both of which are disposed perpendicularly with the transport path of the paper substrate material. The platen 26 includes an axle 24 and has a slightly abrasive or sticky surface similar to the roller 16 described above to prevent slippage of the paper substrate material 14 as it traverses the platen. The platen 26 is rotatable about the axle 24, and may be rotated by use of an external driving force, such as provided by a capstan motor driven gear and/or belt. The thermal print head 25 is disposed adjacent to the platen 26, and has linearly disposed print elements (not shown) that face the surface of the platen. The thermal print head 25 is attached to a frame member 28, that may be selectively pivoted to press the paper substrate material 14 between the platen 26 and the print head. The thermal print head 25, platen 26 and frame member 28 may all be further combined within a single printing mechanism 22 (partially illustrated).

As illustrated in FIGS. 3 and 4, a rotational rate detector is provided to determine the rotational rate of the platen 26. The rate detector comprises a control disk 30 and a photodetector 42. The control disk 30 comprises a plurality of spokes 32 that extend outwardly in a radial direction from a central portion of the disk, and an outer frame 36 having a circular shape. Each of the spokes 32 terminate at the outer frame 36. Open spaces are defined between adjacent ones of the spokes 32. The control disk 30 is coupled axially to the platen 26, with an end 38 of the axle 24 protruding outwardly through a central aperture of the disk. The axle end 38 has a flat portion 37 that provides a key and insures that the disk 30 and platen 26 rotate together.

The photodetector 42 further includes a light source, such as a light emitting diode (LED), and a light receiver, such as a photo-diode, photo-transistor or charge coupled device (CCD). As known in the art, the photodetector 42 produces an electrical signal representative of a characteristic of light provided on the light receiver. The photodetector 42 is disposed relative to the control disk 30 such that the light source is on one side of the disk and the light receiver is on the other side of the disk. As the control disk 30 rotates, light from the light sources is periodically blocked from passing to the light receiver by the rotating spokes 32. Accordingly, an electrical signal provided by the photodetector 42 oscillates in a sinusoidal manner, with a frequency of the signal being proportional to a rotational rate of the platen 26. The number and spacing of the spokes 32 can be selected based on the requirements of the printer; while a higher number of spokes would provide more accurate rotational rate information, it would also be more difficult to manufacture.

It is anticipated that the disk 30 be comprised of an initially solid material, such as metal, that is selectively machined or etched to provide the spaces and spokes 32. Alternatively, the disk 30 may be comprised of a translucent material, such as plastic or glass, onto which the spokes 32 are drawn or painted. In yet another alternative embodiment, the disk 30 may be comprised of a light refracting material, with the spokes 32 regions of a differing index of refraction. The photodetector 42 would detect the spoke regions formed by use of any of these alternatives in the same manner as described above.

FIGS. 6 and 7 illustrate an exemplary photodetector unit 60 that provides the photodetector 42 described above. The photodetector unit 60 includes a body portion 62, mounting base portion 64, and a slot portion 65. The mounting base portion 64 includes a pair of washer-like openings extending laterally from opposite sides of the body portion 62. The openings permit mounting of the photodetector unit 60 to the transporting mechanism, such as by screws or bolts. The slot portion 65 provides a passageway in which the disk 30 will rotate, and necessarily has a width greater than an associated width of the disk.

On opposite side surfaces of the slot 65, a light emitter 66 (see FIG. 6) and a light receiver 68 (see FIG. 7) are disposed. As noted above, the light emitter 66 may be provided by an LED. The light receiver 68 may be provided by a phototransistor having an emitter, collector and base, with the base receiving a light input from the light emitter 66. Upon presence of light from the light emitter 66, the phototransistor is placed in a conductive state such that current is drawn between the emitter and collector. Accordingly, the collector current provides the electrical signal characteristic of the light provided on the light receiver 68, from which the rotational rate of the disk 30 may be discerned.

Figure 5:
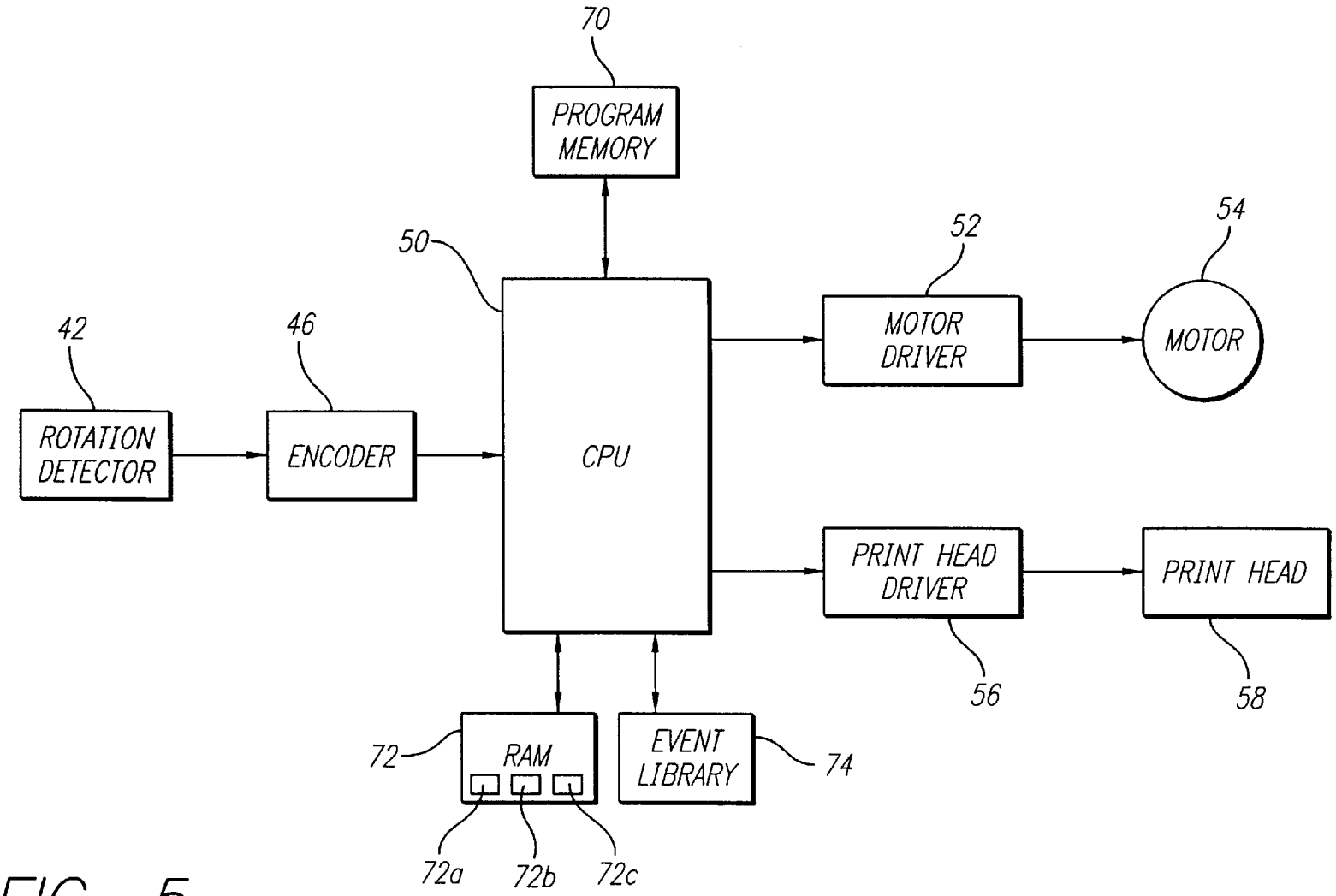
FIG. 5 is a block diagram illustrating the printer feedback control apparatus.

Referring now to FIG. 5, a block diagram illustrating the operation of the printer feedback control apparatus is provided. The photodetector 42 comprises a rotation detector that provides an electrical signal relating to a rotational rate of the platen 26. The electrical signal is provided to an encoder 46 that converts the electrical signal to a digital value. The encoder 46 may comprise an analog to digital (A/D) converter operating at a predetermined sampling rate. The digital value is provided to a central processing unit (CPU) 50, that controls the transporting and printing functions of the thermal printer in accordance with instructions stored in a program memory 70. The CPU compares the digital value to predicted step data stored in random access memory (RAM) 72, and calculates the next step value. As will be described below, the predicted step data may be generated from various event models stored in an event library 74 and/or may be generated from a harmonic model stored in a harmonic model buffer 72*a*, in conjunction with data stored in a step buffer 72*b* and an input buffer 72*c*, all contained in RAM 72. The CPU 50 provides a control signal to a motor driver 52 that defines a desired rotational rate of a motor 54 that drives the roller 16. In addition, the CPU 50 provides data values to a print head driver 56 that define the information to be printed onto the paper substrate material 14. The data values are translated to electrical control signals to the individual thermal printing elements of the print head 25.

In operation, the payout force of the linerless paper substrate material 14 will typically be at a maximum level when the spool 12 has its maximum diameter, such as when a fresh spool is loaded onto the transport mechanism 10. The increased payout force results in a reduction of the rotational rate of the platen 26. To keep the operation of the print head 25 in synchronization with the transport of the paper substrate material 14, the rotational rate applied to the motor 54 is increased. This feedback control can be continuously adjusted as the payout force changes with the reduction of diameter of the spool 12.

As discussed above, the program instructions stored in program memory 70 control the operation of the CPU 50, and the logic of the feedback control. In the preferred embodiment, the program memory 70 is a conventional read only memory (ROM). However, the program memory 70 could be in the form of a CD ROM, hard disk drive or a computer card such as a PCMCIA card, and/or utilize additional RAM.

Figure 8:
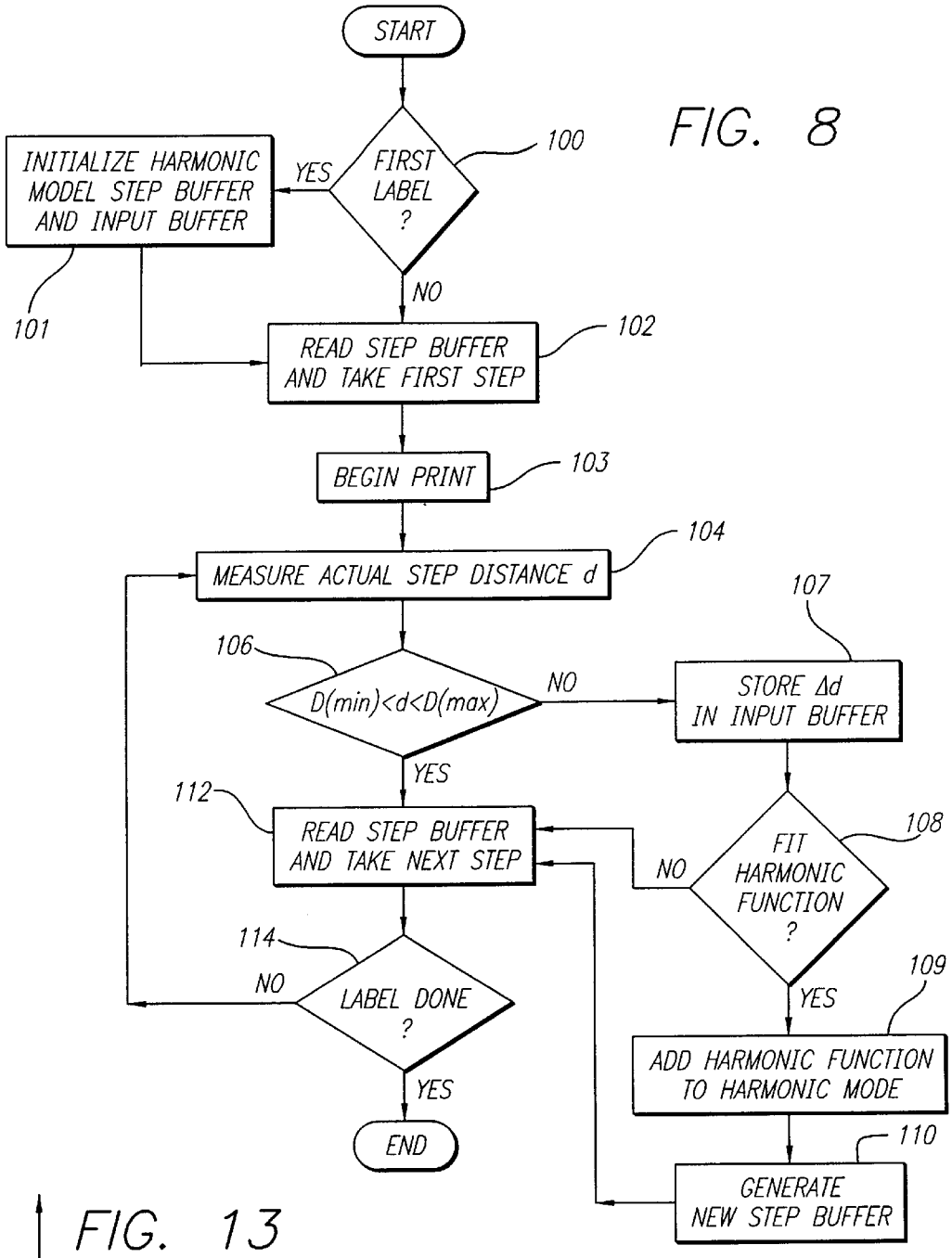
FIG. 8 is a flow chart illustrating the operation of the printer feedback control apparatus utilizing a harmonic model.

A first preferred embodiment of the program instructions stored in program memory 70 will now be described with reference to FIG. 8, which shows a routine that is executed while printing labels, with reference to the block diagram of FIG. 5. First, at step 100, it is determined whether this is the first label to be printed. If this is the first label, the harmonic model buffer 72*a*, the step buffer 72*b* and the input buffer 72*c*, all contained in RAM 76, are initialized at step 101. As will be discussed below, a harmonic model is constructed from a plurality of harmonic functions, stored in the harmonic model buffer 72*a*, and used to generate step data for the step buffer 72*b*. Initially, the harmonic model generates a constant value, representing the expected uniform step size of the platen 26.

The step buffer 72*b* contains a discrete number of steps (for example, 20 steps) the values of which are ultimately provided to the motor driver 52 to operate the motor 54. FIG. 11 graphically illustrates the type of data values that may be present in the step buffer. In the preferred embodiment, the step data represents the amount of torque to be applied by the motor at each step. The torque may be adjusted higher, such as to level maximum 152, or lower, such as to level minimum 153, to compensate for the variations in payout force that are expected to occur. Initially, the step data values are set at a constant torque value along the line 150, as generated by the harmonic model 72*a*.

Alternatively, the transport rate of the paper substrate material 14 may be kept in synchronization with the print head pulse by altering the print head pulse. Under this embodiment, the motor driver 52 would receive a constant torque value, and the step buffer 72*b* would contain pulse data representing the variations in the print head pulse. These pulse data values would be sent to the print head driver 56 which will change the print head pulse consistent with the variations in the step size.

The transport rate could also be kept in synchronization with the print head pulse by altering the step timing sequence. In this embodiment, the print head pulse and amount of torque would be constant, and the step buffer 72*b* would contain timing data representing the amount of time the stepping motor must wait between steps.

In the preferred embodiment, the step buffer 72*b* will have a dynamic size. The step data in the step buffer 72*b* will represent the amount of torque to be applied for each step in a detected periodic cycle. Thus, the step data is repeated during operation. Initially, the step buffer 72*b* can have a length of one step, because the harmonic model 72*a* is initialized to generate constant step values. As periodic payout forces are detected, and the harmonic model 72*a* is updated, the size of the step buffer 72*b* can be increased as large as necessary to contain all detected cycles. For example, the number of steps could be equivalent to the number of steps in one full rotation of the platen, the number of steps needed to print one full label or some multiple thereof. The size of the step buffer 72*b* will be limited by the size of the RAM 72 and, as will be discussed below, the print quality to be achieved.

The input buffer 72*c* is used to record the deviations in actual step size from an expected step size. By analyzing deviations in step size, the harmonic model stored in the harmonic buffer 72*a* and the step data stored in the step buffer 72*b* can be updated to provide a better prediction of future step sizes. Initially, the values in the input buffer 72*c* will be set to zero, representing no current detected deviations in step size. The number of steps in the input buffer should be sufficiently large to allow for the recognition of periodic deviations.

Returning now to FIG. 8, with reference to FIG. 5, in step 102 the CPU 50 accesses the first step value from the step buffer 72*b*. This value is sent to the motor driver 52, and the first step is taken into the print area. Printing then begins at step 103. At step 104, the rotational rate of the platen 26 is measured by photodetector 42 by detecting the amount of light that passes through the control disk 30. This value is converted by the encoder 46 into an electrical step value d representing the actual step distance. This actual step distance is fed into the CPU 50, where it is compared to a predetermined tolerance range at step 106.

The tolerance range is defined by D(min) and D(max). The value D(min) represents the smallest step size that is acceptable, while the value D(max) represents the largest step size that is acceptable. In the preferred embodiment, the tolerance range is determined by taking the expected step size and calculating an error range around this value that would be acceptable as an actual step size. The size of the tolerance range could depend upon many factors including media type, print mode and print quality, all of which could change during printing. In an alternate embodiment, the value d may represent the sum of a series of actual step sizes; D(min) and D(max) would then represent the acceptable tolerance range for the given series.

In still another alternate embodiment, there can be a second tolerance range, D2(min) and D2(max), which represents an actual step size so large or so small as to constitute an error condition. If d is outside this range, the CPU 50 will send an error message to the printer console, and printing will stop until the error is corrected. A paper jam is one example of a condition that could cause such an error.

Returning now to step 106 of the first preferred embodiment, if the value d is outside the range of acceptable values, then the deviation in step size is considered extreme and if such deviation is found to occur periodically, the step buffer 72*b* will be modified to compensate for this deviation. At step 107, a value Ad is calculated, representing the amount of actual deviation in the last measured step. The value Δd will be stored in the input buffer 72*c*, and used in conjunction with past step deviations stored in the input buffer 72*c* and the present harmonic model stored in the harmonic model buffer 72*a* to generate future step data.

After Δd is stored, the input buffer 72*c* is analyzed at step 108 for periodic deviations that can be modeled as a harmonic function. If no harmonic function is found, the step buffer remains unchanged and the algorithm continues at step 110. If the data stored in the input buffer 72*c* can be modeled as a harmonic function, this new harmonic function is generated and the values in the input buffer 72*c* are reset to zero. The new harmonic function produces step data as a function of amplitude, phase, period and exponential decay, and is added to the harmonic model at step 109. An example of typical harmonic function can be seen in curve 154 of FIG. 12. Because the performance of mechanical systems can often be modeled as the sum of harmonic functions, each new harmonic function allows the harmonic model to more closely predict the performance of the transport mechanism 10.

Figure 12:
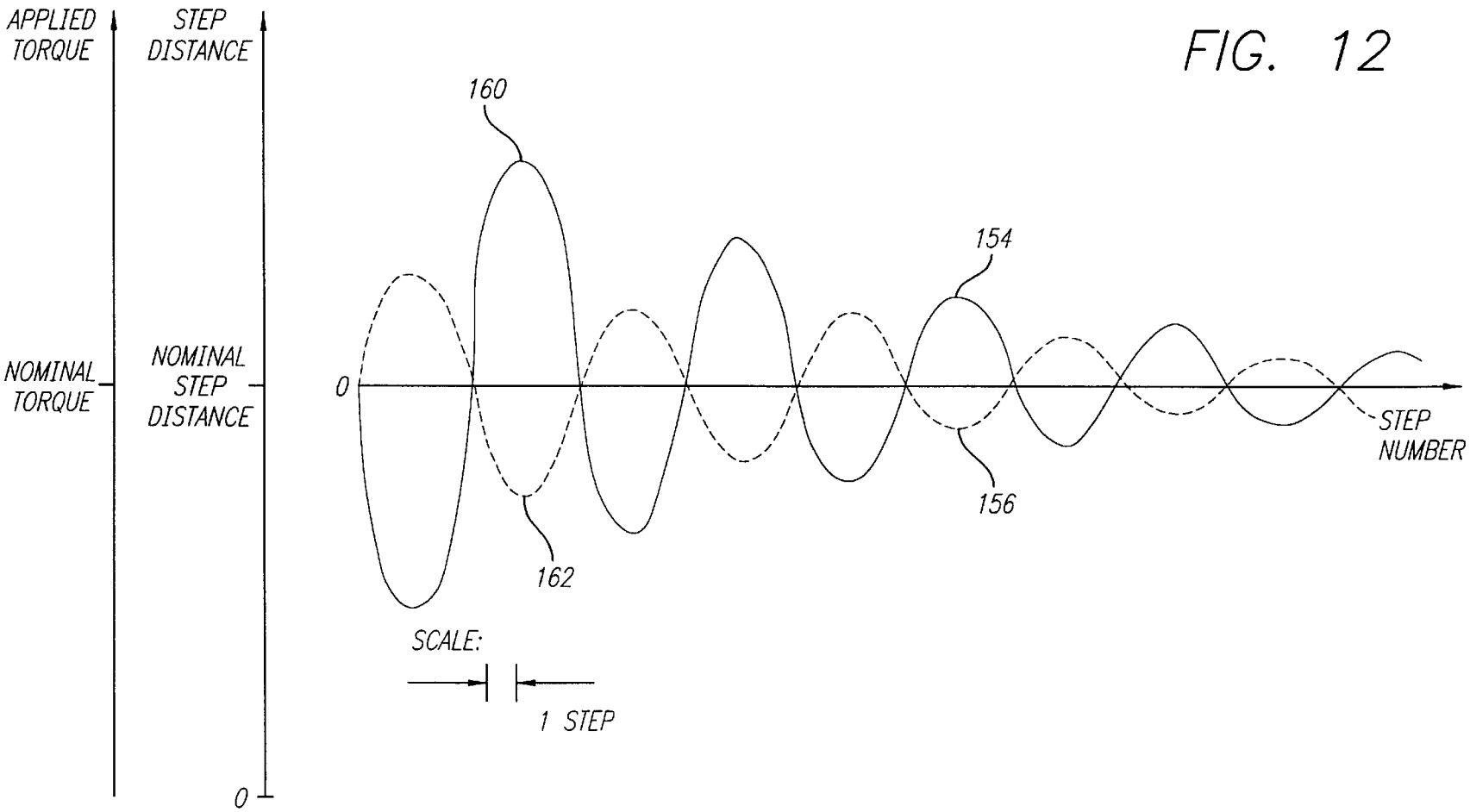
FIG. 12 is a chart illustrating a harmonic function and corresponding torque compensation.

The updated harmonic model is then applied to the entire step buffer 72*b* at step 110, as illustrated in FIG. 12. For each step in the step buffer 72*b*, the harmonic model generates data that predicts the future step size as illustrated in curve 154. This step size is used to generate a corresponding torque value as illustrated in curve 156. If the predicted step size is large, as at point 160, the amount of torque to be applied at that step is reduced, such as at point 162, to offset the increased step size so that the resulting actual step size will remain constant, along the line 164 at every step. It should be evident to one skilled in the art that the step buffer can be modified in any manner that would predict the future step distances based on prior feedback.

Next, at step 112, the CPU 50 reads the next step value from the step buffer 72*b* and sends the corresponding digitized signal to the motor driver 52 causing the motor 54 to take the next step, thereby advancing the paper substrate material 14 to the next print line. In the preferred embodiment, the position of the next step value in the step buffer 72*b* will be marked with a pointer stored in RAM 72. The pointer will advance one position in the step buffer 72*b* for each step that is taken. When the last step value in the step buffer 72*b* is read, the pointer is repositioned to the beginning of the step buffer 72*b*, allowing the data values to be cycled through during printing. The position of the next step value could be marked using other methods known in the art, for instance, utilizing the step buffer 72*b* as a FIFO queue or utilizing the step buffer 72*b* as an array where the position of the next step value is stored as the row number in the array.

At step 114, it is determined whether printing is complete. If at least one more line needs to be printed, then the printing continues while steps 104–114 are repeated. If all of the lines have been printed, printing stops and the algorithm ends.

In an alternative embodiment, after printing stops, the harmonic model stored in the harmonic model buffer 72*a* is saved in a nonvolatile memory. This stored harmonic model can be used to initialize the harmonic model buffer 72*a* at step 101 the next time printing begins. The stored harmonic model should provide a better prediction of future step sizes than the harmonic model initially generated before printing. By storing the harmonic model in the nonvolatile memory, the printer will adapt to periodic deviations that are likely to be present during future printing operations. For instance, because the payout forces change as the print spool becomes smaller, the harmonic model will slowly change as well. Further, as parts on the transport mechanism 10 wear as a result of heavy use, the harmonic model will detect and compensate for any corresponding change in the transport rate of the paper substrate material 14.

In another alternative embodiment, a plurality of harmonic models can be stored and the present print environment (e.g., print mode, media type, etc.) can be used to select the best harmonic model during the initialization at step 101. For instance, a high-speed print mode may use a different harmonic model than a slower print mode.

Other modifications of the first preferred embodiment of the program instructions have also been contemplated. For instance, the algorithm can be modified to operate without the step buffer 72*b* by generating the next step values directly from the harmonic model. Also, the algorithm of FIG. 8 can be modified to operate without the input buffer 72*c* by updating the harmonic model at every step. Further, other mathematical models can be utilized to predict future step sizes based on past step values, in addition to, or in place of, the harmonic model as described above. One such alternative model is discussed below in the second preferred embodiment.

Figure 9:
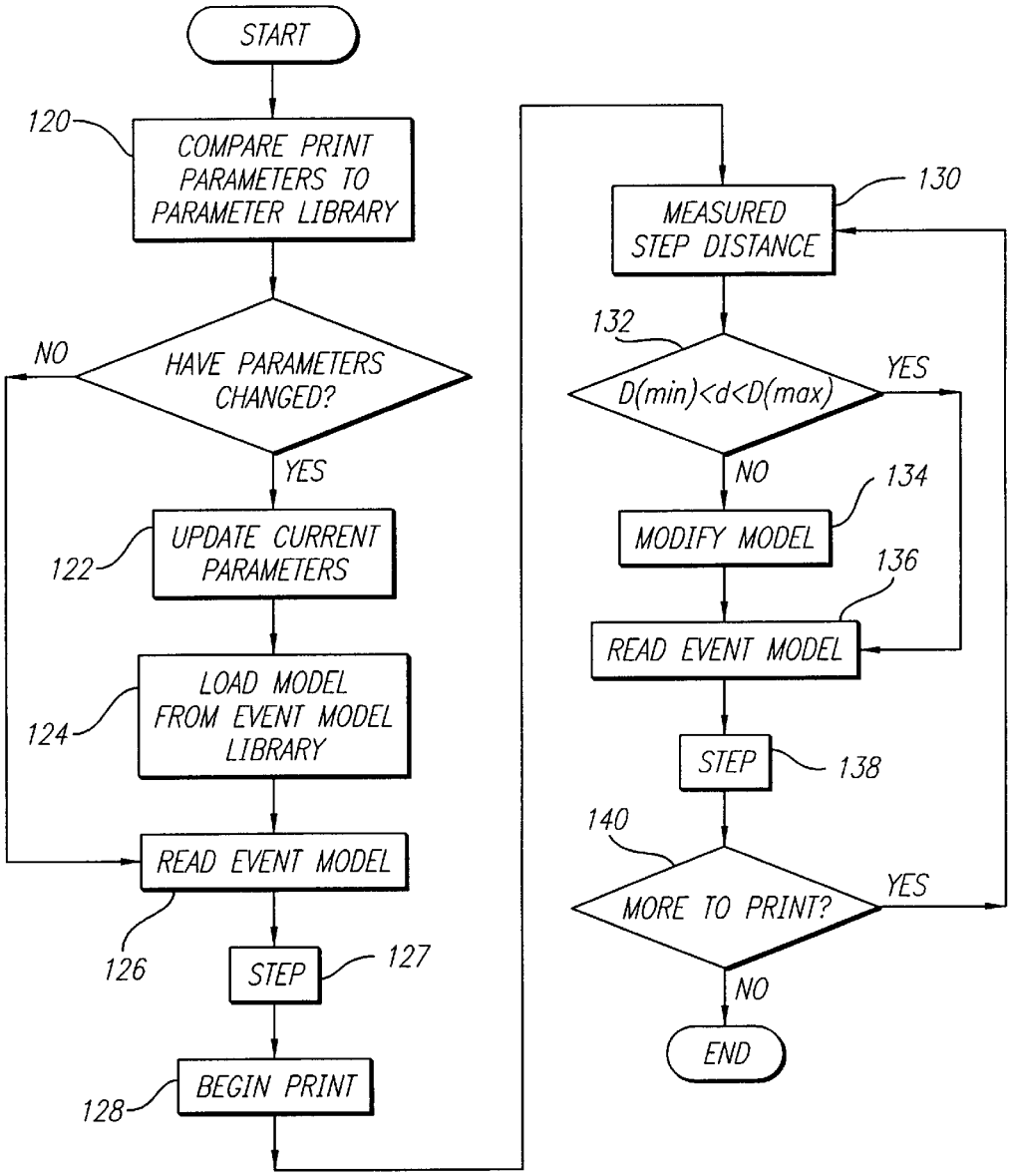
FIG. 9 is a flow chart illustrating the operation of the printer feedback control apparatus utilizing an event library with periodic compensation.

A second preferred embodiment of the program instructions will now be described with reference to FIG. 9. This embodiment differs from the embodiment described in FIG. 8 by employing an event library 74 which is used to create an event model based on current printing criteria. The event model contains predicted step data for an entire label, and is created from various data models in accordance with certain print parameters that are present before the label is printed. Based upon these print parameters, instantaneous variations in the payout force can be predicted before printing of the label begins. For instance, as mentioned above, some fluctuations in payout force may arise because of the changing size of the print substrate spool. Because the spool gradually decreases in size during printing, the corresponding change in payout force can be predicted before printing begins.

The event library 74 can contain a data model for any variable that may effect printing and pay-out force and can be predicted. For instance, in the preferred embodiment the event library contains periodic models, media hit models and print head sticking models. The periodic models are typically harmonic functions that predict the rotational rates of the various pulling and rotating mechanisms of the printer itself. There may be separate periodic models for each individual mechanism associated with the printer, or a plurality of mechanisms may be combined into one periodic model.

The media hit models predict variations in payout force that result from the given media type, the print mode, the current size of the spool, etc. For instance, one media hit model would compensate for variations in payout force that occur when printing first begins. A large print spool will often lead to a small initial step size as printing begins. This requires a high torque value to start the paper substrate material 14 moving through the transport mechanism 10 at the proper rate. However, this high torque value will result in the actual step size quickly increasing beyond an acceptable range. Thus, the torque must be lowered to compensate for the increased step size. The media hit model can be used to predict these swings in step size and generate a series of torque values to maintain an acceptable step size as printing begins.

The media hit models contain information such as the given type of paper, how much of the print roll is still available and the print mode that is being utilized. All could have effects on the payout force that could require compensation of the motor stepping sequence. The type of paper can be input into a memory by the user. The available paper in the spool can be determined in a variety of ways. In the preferred embodiment, the printer will keep track of how much paper has printed in the RAM 72, such that the size of the current print spool can always be determined. In an alternate embodiment, there can be a detection system (not shown) for determining the width of the remaining roll. The print mode is generally determined by the control panel of the printer or by software control from a computer.

The print head sticking models predict when the paper substrate material 14 is likely to stick to the print head. As the paper substrate material 14 heats up, it has less tack. As it cools down, it becomes more likely to stick to the print head, which can slow down the movement of the paper substrate material 14. The heat level is generally a function of whether a black line or white line is being printed. A typical print head sticking model will apply a function of the number of dots printed, past printing activity, the type of media, ambient temperature and print speed.

It is expected that the step data for each model in the event model library will be created in a test environment by analyzing different print media, under different print modes, and under a variety of print conditions. The data concerning the various payout forces can be collected and recorded by measuring and storing the rotational rates of the platen with the rotation detector 42.

Figure 13:
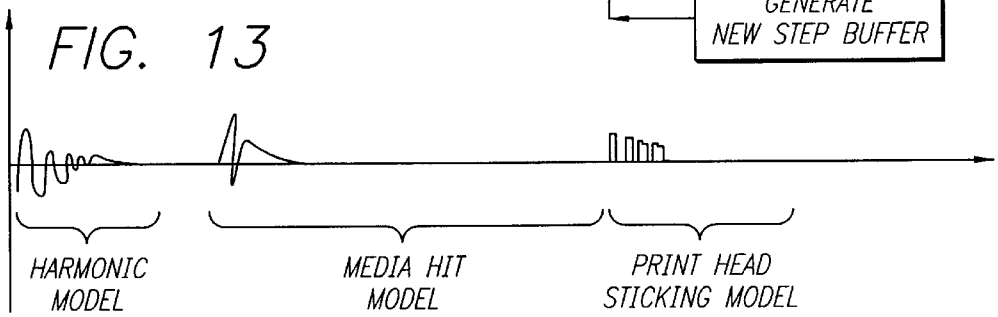
FIG. 13 is a chart illustrating an event model.

The operation of the second embodiment of the program instructions utilizing the event model will now be described. First, at step 120, current print parameters are compared to print parameter values stored in the RAM 72. As mentioned above, the print parameters may contain any variable that affects payout forces in a predictable manner, for instance: current media type, amount of paper remaining on media roll, print mode, etc. If the parameters have changed, then the new parameters are updated at step 122. These new parameters are then used at step 124 to create a new event model. A sample of an event model is graphically illustrated in FIG. 13. In the preferred embodiment, the current parameters are used to locate the applicable models in the event model library 74, through look-up tables stored in the event model library 74.

The various models are then superimposed, step by step, so that at each step there is one step data value representing the total torque that will be applied at that step to compensate for all of the predicted payout forces. The total torque calculated is based on the predicted interaction among the various models. For instance, a media hit model might reduce the amount of torque needed to compensate for the predicted payout forces of a periodic model, and vice versa. Thus, the models could be combined such that only 70% of the compensation for the media hit model and 50% of the compensation for the periodic model will be combined. These interaction compensation factors can be calculated in a laboratory setting as each event model is created.

The completed event model is then loaded into the RAM 72, where it will be accessed by the CPU 50 and applied until a change in print parameters is detected. In the preferred embodiment, the current print parameters are updated after printing each label and a change in print parameters can be detected at that time. In operation, the event model predicts the various instantaneous payout forces and controls the step size of the stepping motor during printing.

Next, at step 126, the CPU 50 retrieves the first step data value from the event model. This step data value is sent to the motor driver 52 and the platen roller moves forward one step in accordance with that information. Printing of the label then begins at step 128. The actual step distance d is then measured at step 130 and compared to the threshold values D(min) and D(max) at step 132. If the value d is outside the threshold range, then the event model is modified at step 134 to compensate for periodic deviations in step size. The threshold range is calculated in the same manner as described with respect to the first preferred embodiment.

At step 134, the event model is modified by applying a function of $\Delta d$ to the current step value of the event model. For instance, the new step value could be equivalent to the old step value plus 2.5% of $\Delta d$. Thus, if the given discrepancy is periodic, the step value will increase each time this step in the event model is reached, until the event model accurately predicts the future step sizes.

Alternatively, the event model can be modified in a manner similar to modification of the step buffer 72*b* in the first preferred embodiment. The value $\Delta d$ could be stored in an input buffer 72*c* which is used to generate a harmonic model 72*a*. This harmonic model could then be superimposed on top of the event model, or kept separate and applied in conjunction with the event model at each step. Under either approach, the updated event model contains data for predicted instantaneous and periodic deviations in step size and should be a better predictor of subsequent step sizes.

The next step data value is read from the event model at step 136. This step data value is sent to the motor driver 52 and the platen roller moves forward one step, at step 138, in accordance with that information. At step 140 it is determined whether the printing of the label is complete. If there is more to print on the label, then program steps 130–140 are repeated until the printing of the label is complete. If there is another label to be printed, then program control the entire algorithm of FIG. 9 repeats for that new label. The new parameters will be compared to the prior parameters at step 120 to determine whether the same event model should be used in printing the next label.

At the end of each label the event library 74 is updated. The current event model, as modified in step 134, is compared to the original event model, as generated in step 124. If the current event model is found to be significantly different, it is stored in a nonvolatile memory where it can be selected in place of the original event model when the given event parameters are repeated. Thus, the event library will adapt to the changes in the individual printer due to wear or new parts, changes in print media, etc.

Other modifications of the second preferred embodiment of the program instructions have also been contemplated. For instance, the current print parameters may change in the middle of the label, requiring a new event model to be loaded. Thus, the above algorithm can be altered to perform the comparison of the current print parameters, as in step 120, periodically while printing a label.

A third embodiment of the present invention will now be described with respect to FIG. 10. The algorithm in this embodiment is designed to compensate for variable payout forces on printers that do not have a rotational rate detection device 42. An event model is selected in steps 120–124 in the same manner as described in the second preferred embodiment illustrated in FIG. 9. After the event model is loaded, printing of the label beings at step 128. The first step data value is read from the event model at step 136. This step data value is sent to the motor driver 52 and the platen roller moves forward one step, at step 138, in accordance with that information. At step 140 it is determined whether the printing of the label is complete. If there is more to print on the label, then program steps 136–140 are repeated until the printing of the label is complete. If there is another label to be printed, then the entire algorithm of FIG. 9 is repeated for that label.

Having thus described preferred embodiments of the printer feedback control to compensate for variable payout force, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An apparatus for use in a thermal printer having a print head for printing information onto a paper substrate material, said paper substrate material having a transport rate that is affected by a payout force as it is transported through the thermal printer, said apparatus comprising:

a transporting mechanism for transporting said paper substrate material through a print region of said thermal printer;

a central processor;

a random access memory storing data for predicting periodic variations in said payout force affecting said transport rate; and a program memory storing program instructions for controlling said processor, said program instructions being operative with said processor for reading said data from said random access memory, for generating a driving signal for said transporting mechanism, and for generating a printing signal for said print head;

wherein said transport rate of said paper substrate material through said print region is synchronized with said print head.

2. The apparatus of claim 1, wherein said transporting mechanism comprises:

a platen in contact with said paper substrate material at said print region; and a rotational rate detector for providing an electrical signal to said central processor, said electrical signal corresponding to a detected periodic changes of the rotation of said platen.

3. The apparatus of claim 2, wherein said rotational rate detector comprises:

a light source;

a disk having alternating radially disposed regions of different light conductivity; and a photodetector adjacent to said disk;

wherein said disk is at least partially illuminated by light provided by said light source; and wherein said photodetector provides the electrical signal to said central processor, corresponding to detected periodic changes of said light illuminated onto said disk during rotation of said disk in cooperation with said platen.

4. The apparatus of claim 2, wherein said random access memory includes a harmonic model buffer for storing a harmonic model, wherein said harmonic model is used to generate step data for predicting said periodic variations in said payout force.

5. The apparatus of claim 4, wherein said program instructions further are further operative with said processor for:

converting said electrical signal into an actual transport rate of said paper substrate material; and generating a harmonic model based on said actual transport rate to predict said periodic variations in said payout force.

6. The apparatus of claim 5 wherein said random access memory further includes a step buffer for storing said step data, and an input buffer for storing data associated with said actual transport rate, wherein said harmonic model is generated from the stored data in said input buffer, and wherein said harmonic model is used to generate the stored step data.

7. The apparatus of claim 1, wherein said random access memory further comprises a current event model having step data for predicting said periodic variations in said payout force that affects said transport rate of said paper substrate material.

8. The apparatus of claim 7, further comprising an event library comprising a plurality of event models, and wherein said program instructions are further operative with said processor for generating said current event model from at least one of said plurality of event models, in accordance with a current printing environment.

9. The apparatus of claim 8 wherein said event library further comprises at least one periodic model having step data defined by a harmonic function that predicts the operation of at least one printing mechanism.

10. The apparatus of claim 9 wherein said event library further comprises at least one media hit model having step data defined in accordance with at least one of a type of said paper substrate material, a print mode and a size of a paper substrate spool.

11. The apparatus of claim 6 wherein said event library further comprises at least one print head sticking model having step data defined as a function of at least past printing activity and ambient temperature.

12. The apparatus of claim 7, wherein said transporting mechanism comprises:

a platen in contact with said paper substrate material at said print region; and a rotational rate detector for providing an electrical signal to said central processor, said electrical signal corresponding to a detected periodic changes of the rotation of said platen.

13. The apparatus of claim 12, wherein said program instructions are further operative with said processor for:

converting said electrical signal into an actual transport rate of said paper substrate material; and modifying said current event model in accordance with said actual transport rate to compensate for said detected periodic changes of the rotation of said platen.

14. The apparatus of claim 13, wherein said program instructions operative with said processor for modifying said current event model are further operative for:

generating a harmonic model based on said actual transport rate; and modifying said current event model with said harmonic model.

15. An apparatus for use in a thermal printer for printing information onto a paper substrate material, comprising:

means for transporting said paper substrate material;

means for predicting periodic variations in a payout force affecting a transport rate of said paper substrate material; and means for controlling said transport rate of said paper substrate material in accordance with said predicted periodic variations in said payout force.

16. The apparatus of claim 15 further comprising means for detecting a transport rate of said paper substrate material.

17. The apparatus of claim 16 wherein said means for predicting periodic variations in said payout force further comprises means for generating a harmonic model.

18. The apparatus of claim 16, wherein said detecting means further comprises:

a light source;

a disk axially coupled to a platen and comprising alternating radially disposed regions of different light conductivity, said disk being at least partially illuminated by light provided by said light source; and a photodetector adjacent to said light reflective disk, said photodetector providing an electrical signal corresponding to detected periodic changes of said light illuminated onto said disk during rotation of said disk in cooperation with said platen;

whereby, said electrical signal is representative of said rotational rate of said platen.

19. The apparatus of claim 15 wherein said means for predicting periodic variations in said payout force further comprises an event model.

20. A method for compensating for variations in a payout force affecting a transport rate of a paper substrate material through a thermal printer, said thermal printer having a print head for printing information onto said paper substrate material, and a transporting mechanism for transporting said paper substrate material, said method comprising the steps of:

transporting said paper substrate material through a print region of said thermal printer;

predicting periodic variations in said payout force affecting said transport rate; and synchronizing said transport rate of said paper substrate with said print head in accordance with said predicted variations in said payout force.

21. The method of claim 20 wherein the step of predicting further comprises generating a current event model in accordance with a set of current print parameters.

22. The method of claim 21 wherein the step of synchronizing further comprises sending a driving signal to said transporting mechanism wherein said driving signal represents an amount of torque for a driving motor to apply to a platen of said transporting mechanism.

23. The method of claim 21 wherein the step of synchronizing further comprises sending a driving signal to said transporting mechanism wherein said driving signal represents a step timing sequence for a stepping motor of said transporting mechanism.

24. The method of claim 21 wherein the step of synchronizing further comprises sending a pulse signal to a print head driver to control the print head pulse of said print head.

25. The method of claim 21 wherein the paper substrate material comprises a plurality of labels transported through the thermal printer, and wherein the step of generating a current event model further comprises periodically generating a current event model while one of the plurality of labels is transported through said print region of said thermal printer.

* * * * *